United States Patent [19]

Armand

[11] 4,396,472

[45] Aug. 2, 1983

[54] NOVEL APPARATUS AND PROCESS FOR THE $TiCl_4$ FEED TO ELECTROLYSIS CELLS FOR THE PREPARATION OF TITANIUM

[75] Inventor: Marcel Armand, Meylan, France

[73] Assignee: Pechine Ugine Kuhlmann, Paris, France

[21] Appl. No.: 313,230

[22] Filed: Oct. 20, 1981

[30] Foreign Application Priority Data

Nov. 27, 1980 [FR] France ..... 80 25505

[51] Int. Cl.[3] ..... C25C 3/26; C25C 3/28; C25C 3/34; C25C 7/06

[52] U.S. Cl. ..... 204/64 T; 204/64 R; 204/246; 204/247

[58] Field of Search ..... 204/64 T, 64 R, 246, 204/247, 231

[56] References Cited

U.S. PATENT DOCUMENTS 2,712,523 7/1955 Alpert et al. ..... 204/64 T 4,113,584 9/1978 Johnson ..... 204/64 T

*Primary Examiner*—Howard S. Williams

*Attorney, Agent, or Firm*—Dennison, Meserole, Pollack & Scheiner

[57] ABSTRACT

The apparatus and the process according to the invention concern the preparation of titanium by electrolysis in a bath of molten halides.

The apparatus comprises a porous diaphragm which is disposed around a feed cathode permitting partial reduction of the $TiCl_4$ introduced into the electrolyte.

The intensity of the current which passes through the feed cathode is so regulated as to maintain a low but non-zero voltage drop, across the diaphragm which is insulated with respect to the feed cathode.

5 Claims, 2 Drawing Figures

NOVEL APPARATUS AND PROCESS FOR THE $TiCl_4$ FEED TO ELECTROLYSIS CELLS FOR THE PREPARATION OF TITANIUM

The apparatus and process which are the subject of this invention concern the preparation of titanium by electrolysis in a bath of molten halides. More particularly, the apparatus and process concern the method of feeding the cell with $TiCl_4$.

A number of publications have described electrolysis cells which provide for the preparation of titanium and which comprise apparatuses for the continuous feed of $TiCl_4$.

The drawings indicated hereinafter will permit better appreciation of the features of the known apparatuses, and the features of the apparatus and process being the subject-matter of this invention.

Figure 1:
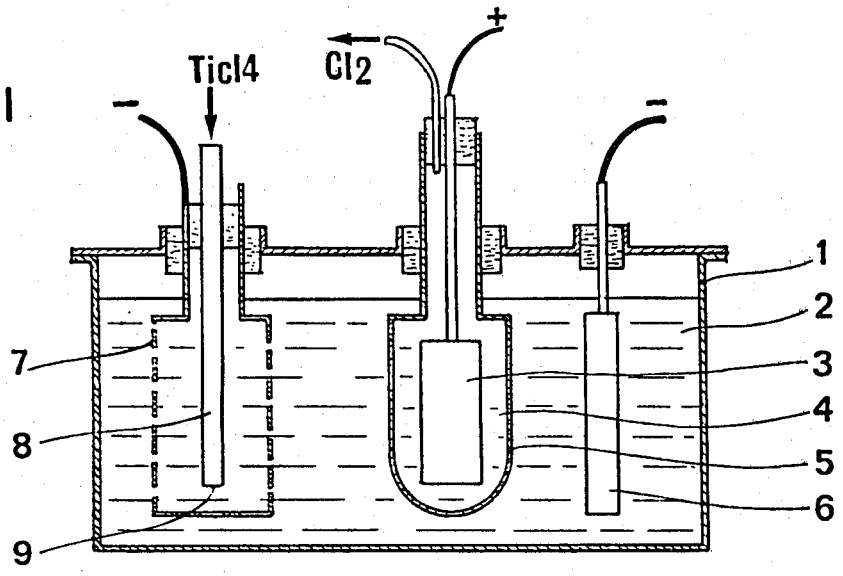
Figure 2:
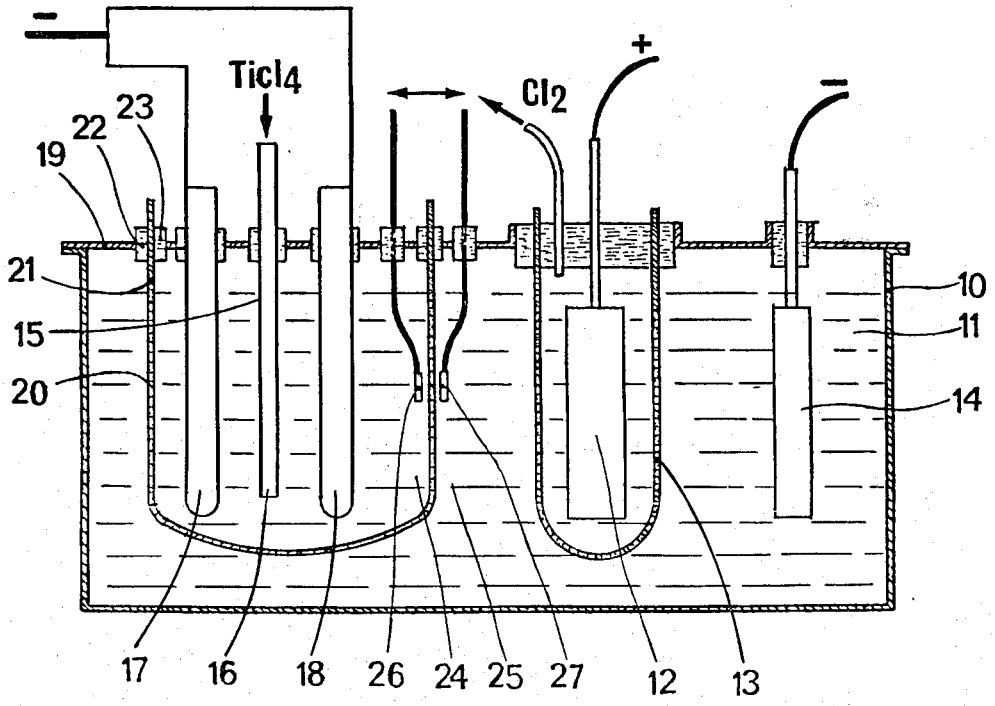

FIG. 1: electrolysis cell of known type for the preparation of titanium, and FIG. 2: apparatus according to the invention for feeding $TiCl_4$ to an electrolysis cell for the preparation of titanium.

French Pat. No. 2 423 555 describes an improved cell for the preparation by electrolysis of polyvalent metals and more particularly for the preparation of titanium. In that cell, a feed apparatus provides for titanium tetrachloride to be introduced into a bath of molten alkali or alkaline earth halides, continuously, as electrolysis progresses.

FIG. 1 shows such an electrolysis cell, of the type described in French Pat. No. 2 423 555, comprising a metal casing 1 containing the molten electrolyte 2. An anode 3 is disposed within an anodic compartment 4. A diaphragm 5 separates the anodic compartment 4 from the remainder of the cell in which the deposit cathode 6 and the feed cathode 7 are disposed. As will be seen from the drawing, the feed cathode 7 is of tubular shape. It comprises for example metal gauze and is connected to the negative terminal of a current source. The metal gauze may comprise for example carbon steel or another metal such as nickel or stainless steel, optionally coated with cobalt. $TiCl_4$ is fed into the interior of the feed cathode 7 by means of the pipe 8 which is disposed in the vicinity of the centreline thereof. The pipe 8 is insulated with respect to the cathode. Under these conditions, it is found that the $TiCl_4$ which issues at the opening 9 of the pipe 8 is at least partially reduced to titanium subchloride which is dissolved in the bath.

The mechanism involved in the reduction of $TiCl_4$ is not known with certainty. In accordance with a theory which is generally admitted, there is a first reaction between the gaseous $TiCl_4$ and the $TiCl_2$ which is dissolved in the bath:

$$TiCl_4 + TiCl_2 \rightarrow 2TiCl_3 \quad (1)$$

Then, in the course of a second reaction, the $Ti^{3+}$ ions which are formed by reaction (1) diffuse into the electrolyte and are reduced at the feed cathode, in accordance with the reaction:

$$Ti^{3+} + 1e^- \rightarrow Ti^{2+} \quad (2)$$

It will be seen that, if the whole of the $TiCl_4$ is to be converted into $TiCl_2$, assuming a 100% ampere efficiency, it is theoretically necessary for the current $I_1$ which passes through the feed cathode to be:

$$I_1 = \frac{1}{2}\frac{q}{1.772} \quad (3)$$

In above-indicated relationship (3), q is the mass of $TiCl_4$ which is introduced into the electrolyte in g/h, and $I_1$ is the strength of the current in amperes.

In the same time, the deposit cathode 6 must have a current $I_2 = I_1$ passing through it in order at each moment to collect an amount of titanium corresponding to the amount which was made soluble. The total current I which passes through the anode is such that:

$$I = I_1 + I_2$$

Under these conditions, no deposit of titanium on the feed cathode should be found. In actual fact, experience has shown that this is not the case. Indeed, metallic titanium is deposited in the form of very fine powder in the vicinity of the feed cathode. This deposit which, with the electrolyte, forms a kind of sludge, interferes with proper operation of the feed cathode; it is very difficult to extract from the cell and it corresponds to a loss of efficiency which may be substantial.

Two hypotheses which are virtually equivalent may account for this abnormal mode of performance:

first hypothesis: under the conditions of operation, $TiCl_2$ is stable only in the presence of a certain amount of $TiCl_3$, otherwise it is dismuted by displacement towards the right of the balanced reaction:

$$\underset{\text{(dissolved)}}{3\,TiCl_2} \rightleftharpoons \underset{\text{(metal)}}{Ti} + \underset{\text{(dissolved)}}{2\,TiCl_3} \quad (4)$$

second hypothesis: the reduction of $Ti^{3+}$ to $Ti^{2+}$ is not effected directly at the cathode by reaction (2), but by way of the following intermediate reactions:

$$Ti^{2+} + 2e^- \rightarrow Ti^{\circ} \quad (5)$$

Ti metal + dissolved 2 $TiCl_3 \rightleftharpoons$ dissolved 3 $TiCl_2$ (5 bis) that is to say, by the reaction (4) displaced towards the left.

In both cases, the final result is the same: the flow of a current intensity $$I_1 = \frac{1}{2}\frac{q}{1.772} \text{ amperes}$$

results in a titanium deposit, either by dismutation of a part of the $TiCl_2$ formed, or by incomplete reduction of the $TiCl_3$ by the metal titanium deposited on the feed cathode by reaction (5) in accordance with the equilibrium condition (4).

The subject of the present invention is an apparatus for feeding $TiCl_4$ to an electrolysis cell for the preparation of titanium, comprising at least one deposit cathode and a feed cathode; the apparatus is a metal diaphragm which is disposed around the feed cathode and which is insulated with respect thereto. Advantageously, reference electrodes disposed on respective sides of the diaphragm are connected to a means for measuring their potential difference.

Another subject of the present invention is a process for feeding an electrolysis cell for the preparation of titanium, comprising at least one $TiCl_4$ feed cathode which is surrounded by a diaphragm which is insulated with respect thereto, wherein the intensity of the current $I_1$ which passes through the feed cathode is regulated so as to maintain a low but not zero voltage drop in the electrolyte which impregnates the diaphragm. Advantageously, the regulating operation is effected by controlling the intensity of the current which passes through the feed cathode, in dependence on the voltage drop in the electrolyte impregnating the diaphragm, or a variable linked to that voltage drop.

The apparatus and process referred to above provide for regulation in respect of the amounts of $TiCl_3$ and $TiCl_2$ dissolved at the feed cathode, in the proportions in accordance with equilibrium condition (4).

FIG. 2 shows a view by way of non-limiting example of a feed cathode apparatus according to the invention.

The apparatus is disposed within a cell 10 for the preparation of titanium from a molten electrolyte 11 by electrolysis. Like the cell shown in FIG. 1, the cell shown in FIG. 2 comprises an anode 12 around which there is disposed a diaphragm 13 and, at least, a deposit cathode 14. Only the feed device according to the invention is described in detail herein. It comprises a pipe 15 which permits the introduction of the $TiCl_4$ which issues into the electrolyte by way of the opening 16. The feed cathode comprises two steel rods 17 and 18 which are disposed on respective sides of the pipe 15. They pass through the cover 19 of the cell, by way of insulating seals, and are connected to the negative terminal of a current source (not shown).

The diaphragm 20 which forms one of the subject of the invention is made of a material which is of sufficient resistance with respect to the electrolyte under the temperature conditions under which the process is operated. It is possible to use for example non-alloyed nickel or nickel-base alloys or steels, preferably stainless steels. The diaphragm is connected in the upper part to the cover 19 of the electrolysing apparatus by means of a sealing annular metal wall 21 which is fixed to the cover 19 by insulating and sealing annular gasket members 22 and 23. The annular wall 21 has its lower part extending into the electrolyte and thus constitutes an obstacle to the circulation of the gases which are present above the electrolyte on respective sides of the diaphragm 20. The essential object of the diaphragm is to impede the diffusion of the $TiCl_3$ which is formed in accordance with reaction (2) by the action of $TiCl_4$ on $TiCl_2$, out of the space defined by the diaphragm. In that way, the region of the electrolyte which is in the immediate vicinity of the rods 17 and 18 which form the feed cathode is enriched in respect of $TiCl_3$, which permits very rapid re-dissolution of the titanium formed upon contact with the rods 17 and 18 by discharge of the divalent titanium ions.

The structure of the diaphragm 20 may be for example in the form of a metal gauze such as a nickel gauze or a sheet which is produced by sintering a metal powder, for example a stainless steel-base powder, and which has a sufficient degree of residual porosity.

Experience has shown that such a diaphragm, which comprises for example nickel gauze and which is insulated with respect to the feed cathode, behaves like an indicating electrode in respect of the oxido-reduction reaction:

$$Ti^{3+} + e^- \rightleftarrows Ti^{2+} \tag{6}$$

The potential of the diaphragm 20 with respect to the electrolyte in which it is immersed may be calculated by one of the two equations set out below, considering either the potential of the inside face of the diaphragm with respect to the electrolyte 24 which is within the space limited by the diaphragm, or the potential of the outside face of the diaphragm with respect to the electrolyte 25 which is outside the diaphragm.

The potential of the inside face of the diaphragm is calculated by the following formula which is well known to electro-chemists:

$$e_o^{Ti3+/Ti2+} + \frac{RT}{F} \ln \frac{a_1^{Ti3+}}{a_1^{Ti2+}} \tag{7}$$

In the above formula, $e_o^{Ti3+/Ti2+}$ represents the normal potential for the reaction (6), and $a_1^{Ti3+}$ and $a_1^{Ti2+}$ represents the respective activities of the ions $Ti^{3+}$ and $Ti^{2+}$ in the volume of electrolyte 24 contained in the space surrounded by the diaphragm 20.

The potential of the outside face of the diaphragm 20 is calculated in an identical manner by the following reaction:

$$e_o^{Ti3+/Ti2+} + \frac{RT}{F} \ln \frac{a_2^{Ti3+}}{a_2^{Ti2+}} \tag{8}$$

In the above formula, $a_2^{Ti3+}$ and $a_2^{Ti2+}$ represent the respective activities of the $Ti^{3+}$ and $Ti^{2+}$ ions in the electrolyte with which the outside face of the diaphragm 20 is in contact.

By virtue of the presence of Ti metal on the deposit cathode 14, the electrolyte 25 is in a condition of equilibrium with the titanium metal in accordance with the equilibrium reaction (4), and it is also possible to write the following equation:

$$e_o^{Ti3+/Ti2+} + \frac{RT}{F} \ln \frac{a_2^{Ti3+}}{a_2^{Ti2+}} = e_o^{Ti2+/Tio} + \frac{RT}{2F} \ln a_2^{Ti2+}$$

in which $e_o^{Ti2+/Tio}$ represents the normal potential of the reduction of $Ti^{2+}$ ions to the metal state, the other parameters of the equation being as already defined hereinbefore. This relationship shows that, for a given amount of titanium dissolved in the electrolyte 25, that potential is fixed.

With the cell being supplied with a current $I = I_1 + I_2$, the feed cathode being supplied with a current $I_1$, and with a $TiCl_4$ flow rate, $q = 1.772$ I, and the deposit cathode being supplied with a current $I_2$, it is found that three situations may occur, depending on the intensity of the current $I_1$:

(a) the intensity of the current $I_1$ is so selected that $a_1^{Ti3+}/a_1^{Ti2+}$ remains constant and in conformity with the equilibrium value of the reaction (4), that is to say, is equal to $a_2^{Ti3+}/a_2^{Ti2+}$; simple reduction of the $Ti^{3+}$ ions to the state $Ti^{2+}$ is then observed at the feed cathode, to the exclusion of any metal deposit, the potentials on respective sides of the diaphragm remain unchanged and equal, and an electron current equal to $I_1$ is established in the metal portions of the diaphragm, causing the reduction of the $Ti^{2+}$ ions to the metal state on the outside face of the diaphragm and the oxidation in an equivalent amount of the $Ti^{2+}$ ions to the state $Ti^{3+}$ on the inside face; however, at the same time, the feed in respect of $TiCl_4$ causes the appearance of a flow of electrolyte 24 through the diaphragm, which entrains the $TiCl_3$ which is thus formed towards the outside face of the diaphragm where it reacts on the deposited Ti, giving $TiCl_2$ again.

(b) the current intensity $I_1$ is selected at a value higher than the above-indicated value; an excess of $TiCl_2$ is produced at the feed cathode, a part of that excess is directly reduced to the metal state on that cathode, and the remainder is dismuted in the electrolyte 24 in accordance with the equilibrium (4), producing very fine particles of Ti which, with the electrolyte, form a kind of sludge; the ratio $$a_1^{Ti3+}/a_1^{Ti2+}$$

thus remains unchanged, as also do the potentials on respective sides of the diaphragm. The current $I_1$ still passes by electron flow with, as a consequence thereof, the deposit of metal titanium on the outside face and the formation in an equivalent amount of $Ti^{3+}$ ions on the inside face; however, the excess $TiCl_3$ which is thus formed is in turn immediately reduced to the state of $TiCl_2$ by the sludges of metal titanium in suspension in the electrolyte 24, and the flow of electrolyte 24 passing through the diaphragm then no longer contains sufficient $TiCl_3$ to redissolve the metal titanium on the outside face of the diaphragm which is progressively clogged.

(c) the current intensity $I_1$ is selected to be of a value less than that selected in (a): an excess of $TiCl_3$ which is not reduced at the feed cathode remains dissolved in the electrolyte and the term $$\frac{RT}{F}\ln\frac{a_1^{Ti3+}}{a_1^{Ti2+}}$$

decreases in absolute value, and a voltage drop $$\frac{RT}{F}\ln\frac{a_1^{Ti3+}}{a_1^{Ti2+}}-\frac{RT}{F}\ln\frac{a_2^{Ti3+}}{a_2^{Ti2+}}$$

appears in the electrolyte impregnating the diaphragm which then has an ion current passing through it, which causes a reduction in the electron current in the metal parts of the diaphragm; the deposit of metal titanium on the outside surface of the diaphragm, which results from the flow of that current, decreases and the deposit is completely redissolved by the flow of electrolyte 24 passing through the diaphragm as a result of the feed of $TiCl_4$; excess $TiCl_3$ diffuses into the bath 25. However, in view of the magnitude of the volume of the bath 25 with respect to that of the bath 24, the presence of the above-mentioned excess of $TiCl_3$ does not substantially change the potential at the outside face of the diaphragm, but it is reduced upon contact with the deposit cathode, which reduces the output of the cell.

Definitively, it is the first situation defined in "a" above which corresponds to the best conditions of operation of the cell. The method according to the invention which is permitting to operate cell as close as possible to these best conditions, comprising regulating the current $I_1$ so that there is a voltage drop which is as small as possible but which is not zero, in the bath impregnating the diaphragm. The porosity of the diaphragm is not critical. It must be sufficiently great so as not to cause unduly high retardation of the flow of electrolyte through the diaphragm. It must be sufficiently low to permit a voltage drop in the electrolyte impregnating the diaphragm to be easily detected.

Precisely measuring the voltage drop is an operation which is relatively difficult to perform. On the other hand, it is possible to measure a value which is very close to the potential difference by providing two reference electrodes on respective sides of the diaphragm but without being in contact therewith, for example electrodes 26 and 27 which are sensitive to chlorine ions, such as Ag/AgCl electrodes which are immersed in the electrolyte; the ends of those electrodes pass through the cover of the cell by way of insulating sealing means and are connected to a means for measuring the potential difference, which will serve to give pilot control in respect of the current $I_1$ or, and this amounts to the same thing, the ratio $I_2/I_1$.

Other methods of measuring the potential difference may be used for the apparatus or the process according to the invention, without thereby departing from the scope of the invention.

I claim:

1. An apparatus for the introduction of $TiCl_4$ into an electrolyte of an electrolytic cell for the preparation of titanium comprising at least one feed cathode including (a) means for introducing $TiCl_4$ into said electrolyte, (b) two metal rods extending into said electrolyte and connected to a negative current source, and (c) a metal diaphragm surrounding said feed means and said rods and electrically insulated therefrom.

2. An apparatus according to claim 1 having reference electrodes disposed on respective sides of said diaphragm and means for measuring the potential difference of said reference electrodes.

3. A process for the introduction of $TiCl_4$ into an electrolyte of an electrolytic cell comprising:

(a) providing in an electrolyte cell at least one feed cathode having a metal diaphragm surrounding said feed cathode;

(b) electrically insulating said metal diaphragm from said feed cathode, and (c) establishing a current flow through said feed cathode such that the intensity of said current passing through said feed cathode is regulated so as to maintain a low but non-zero voltage drop in the electrolyte which impregnates said diaphragm.

4. A process according to claim 3 wherein the intensity of the current which passes through the $TiCl_4$ feed cathode is controlled in dependence on the voltage drop in the electrolyte impregnating the diaphragm or a variable linked to said voltage drop.

5. A process according to claim 4 wherein the intensity of the current which passes through the feed cathode is controlled in dependence on the potential difference as measured between reference electrodes disposed on respective sides of said diaphragm.

* * * * *